US008389461B1

(12) United States Patent
Dudley

(10) Patent No.: US 8,389,461 B1
(45) Date of Patent: Mar. 5, 2013

(54) NATURAL CLEANING EMULSION

(75) Inventor: David C. Dudley, Natural Bridge, VA (US)

(73) Assignee: EarthCare USA, Inc., Lexington, VA (US)

( * ) Notice: Subject to any disclaimer, the term of this patent is extended or adjusted under 35 U.S.C. 154(b) by 38 days.

(21) Appl. No.: 12/903,773

(22) Filed: Oct. 13, 2010

(51) Int. Cl.
*C11D 7/50* (2006.01)

(52) U.S. Cl. ..... 510/417; 510/422; 510/428; 510/470

(58) Field of Classification Search ..... 510/417, 510/422, 428, 470
See application file for complete search history.

(56) References Cited

U.S. PATENT DOCUMENTS

| | | | | |
|---|---|---|---|---|
| 4,992,213 | A | 2/1991 | Mallett et al. | 510/427 |
| 5,468,423 | A | 11/1995 | Garabedian, Jr. et al. | 510/423 |
| 5,503,766 | A | 4/1996 | Kulperger | 510/383 |
| 5,529,723 | A | 6/1996 | Drapier | 510/417 |
| 5,723,423 | A | 3/1998 | Van Slyke | 510/188 |
| 6,511,954 | B1 | 1/2003 | Wilbur et al. | 510/417 |
| 6,624,133 | B1 * | 9/2003 | McKenzie et al. | 510/392 |
| 6,645,390 | B1 | 11/2003 | Thames | 252/8.05 |
| 6,670,319 | B1 | 12/2003 | Cheung et al. | 510/503 |
| 7,939,601 | B1 * | 5/2011 | Bergeron et al. | 525/89 |
| 8,048,920 | B2 * | 11/2011 | Joerger et al. | 514/546 |
| 8,088,723 | B2 * | 1/2012 | Cumberland et al. | 510/276 |
| 2002/0119174 | A1 * | 8/2002 | Gardlik et al. | 424/401 |
| 2002/0189634 | A1 * | 12/2002 | Vanhauwermeiren et al. | 134/1 |
| 2005/0113272 | A1 * | 5/2005 | Yeung et al. | 510/235 |
| 2005/0241666 | A1 * | 11/2005 | Bodet et al. | 134/1 |
| 2007/0041924 | A1 * | 2/2007 | Gupta | 424/70.13 |
| 2011/0150950 | A1 * | 6/2011 | Gonzales et al. | 424/401 |
| 2012/0071390 | A1 * | 3/2012 | Fenyvesi et al. | 510/505 |

* cited by examiner

*Primary Examiner* — Gregory Webb
(74) *Attorney, Agent, or Firm* — Pillsbury Winthrop Shaw Pittman LLP

(57) ABSTRACT

The present disclosure relates generally to compositions and methods to disperse oils and other petroleum derivatives from bodies of water and land areas. The present disclosure further relates to biologically-compatible compositions and methods to disperse oils and other petroleum derivatives.

10 Claims, No Drawings

NATURAL CLEANING EMULSION

FIELD OF THE INVENTION

The present disclosure relates generally to compositions and methods to disperse oils and other petroleum derivatives from bodies of water and land areas. The present disclosure further relates to biologically-compatible compositions and methods to disperse oils and other petroleum derivatives.

BACKGROUND

The information provided below is not admitted to be prior art to the present invention, but is provided solely to assist the understanding of the reader.

There have long been serious problems associated with production and transportation of petroleum, oil, and other petroleum derivatives. These problems include leaks and spills of petroleum and its derivatives on land and in bodies of water. The removal of an accidental oil spill from water surface or from land areas may be difficult where it is desired to minimize potential ecological damage. Petroleum-based solvents and emulsifiers are known. However, these materials may not be bio-compatible to presently acceptable degrees.

There remains a need for bio-compatible compositions and methods to solvate and/or emulsify petroleum derivates.

Without limiting the scope of the invention a brief summary of some of the claimed embodiments of the invention is set forth below. Additional details of the summarized embodiments of the invention and/or additional embodiments of the invention may be found in the Detailed Description of the Invention below.

SUMMARY OF INVENTION

An aspect, the invention provides an aqueous emulsion comprising a betaine, a polyglucose, a saponin, and a terpene. An aspect of the invention provides an aqueous emulsion comprising a betaine, a fatty polyglycoside nonionic surfactant, a saponin, a terpene and further comprising a soap. According to yet further aspects, the invention may further comprise a tetraborate, a bicarbonate, and a carbonate.

According to an aspect, the compositions of the invention are fully biodegradeable.

According to an aspect, the composition comprises a betaine which is derived from a plant source such as coconut. According to an aspect, the betaine is a cocobetaine.

According to an aspect, the composition comprises a saponin derived from *Yucca Schidigera* or *Quillaia Saponara Molina*.

According to an aspect, the composition comprises a fatty polyglycoside nonionic surfactant. According to an aspect, the fatty polyglycoside is prepared by reacting glucose with a $C_6$-$C_{20}$ natural fatty alcohol. According to an aspect, the fatty polyglycoside may be decyl glucoside.

According to an aspect, the composition comprises a terpene. According to an aspect the terpene may be limonene. According to an aspect, the limonene may be D-limonene which may be obtained from lemon oil.

According to an aspect, the composition comprises a water-softening agent. According to an aspect, the water-softening agent is a tetraborate. According to an aspect the tetraborate may be sodium tetraborate, commonly known as borax.

According to an aspect, the composition comprises an agent to enhance the ability of a natural soap to complex grease. According to an aspect, the enhancing agent may be a tetraborate. According to an aspect the tetraborate may be sodium tetraborate, commonly known as borax.

According to an aspect, the composition comprises a pH buffer. According to an aspect the pH buffer may be a bicarbonate. According to an aspect the bicarbonate may be sodium bicarbonate.

According to an aspect, the composition comprises a further water-softening agent. According to an aspect, the further water-softening agent is a carbonate. According to an aspect the carbonate may be sodium carbonate.

According to an aspect, the composition comprises a natural soap. According to an aspect, the natural soap is a salt of a plant-derived fatty acid. According to an aspect, the soap is a salt of a $C_6$-$C_{20}$ fatty acid.

According to an aspect, the invention provides a method of making a cleaning emulsion comprising forming a first aqueous co-solvent solution comprising a cocobetaine, a fatty polyglycoside, and a saponin; forming an aqueous solution of a terpene; forming an aqueous solution of a soap; forming an aqueous acid solution comprising a tetraborate, a bicarbonate, and a carbonate; mixing said first co-solvent solution and said terpene solution to form a co-solvent-terpene solution; and forming an emulsion by mixing said soap solution with said acid solution and said co-solvent-terpene solution.

Still other aspects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

DETAILED DESCRIPTION OF A PREFERRED EMBODIMENT

Non-aqueous solvents tend to be toxic, flammable, and/or explosive. Moreover, non-aqueous solvents tend to be non-biodegradeable. The present invention addresses the present invention addresses these concerns by providing compositions based on solvents and emulsifiers derived from renewable, biological sources.

The inventive composition comprises zwitterionic surfactant. Preferably, the zwitterionic surfactant is a betaine. Preferably, the betaine is derived from a plant source such as coconut. An exemplary, but non-limiting, betaine is a cocobetaine which may be 2-(methylamino) acetic acid. The betaine may be present at from about 0.005 to about 0.0065 parts by volume. Preferably, the betaine is present at about 0.005 parts by volume. Preferably, the betaine is derived from a plant source such as coconut.

The inventive composition comprises a fatty polyglycoside nonionic surfactant derived from a plant source. The polyglucoside may be decyl glucoside which is a fatty polyglycoside prepared by reacting glucose, particularly cornstarch glucose with a $C_6$-$C_{16}$ natural fatty alcohol. Decyl glucoside is a nonionic surfactant and can function as either a primary or secondary surfactant. The polyclucoside may be lauryl glucoside. The fatty acid chain may have from about 6 carbon atoms to about 20 carbon atoms. The poly glucoside may be present at from about 0.0045 to about 0.0065 parts by volume. Preferably, the polyglucoside is present at about 0.005 parts by volume. Preferably, the polyglucoside is derived from a plant source such as corn.

The inventive composition comprises a saponin. Saponins function as foaming emulsifying agents and as detergents. Common saponins are yucca extract, derived from *Yucca Schidigera* and quillaia extract, derived from *Quillaia Saponara Molina*. The saponin may be present at from about 0.0045 to about 0.0065 parts by volume. Preferably, the saponin is present at about 0.0050 parts by volume.

The inventive composition comprises a terpene. Preferably, the terpene is a monoterpene. A preferred terpene is limonene. Preferable the limonene is D-limonene, extracted from lemon or from orange rind oil. Terpenes act as solvents and surfactants. The terpene may be present at from about 0.019 to about 0.02 parts by volume. Preferably, the terpene is present at about 0.0195 parts by volume.

The inventive composition comprises a tetraborate and/or another agent that acts to enhance the ability of a natural soap to complex grease. Soap, when mixed with a tetraborate forms an efficient emulsifying agent. The tetra borate may be sodium tetraborate, commonly known as borax, although other tetraborate salts are suitable. The tetraborate may be present at from about 0.040 to about 0.055 parts (weight/volume). Preferably, the tetraborate is present at about 0.050 parts (weight/volume).

The inventive composition comprises a pH buffer. According to an aspect the pH buffer may be a bicarbonate salt. Preferably, the bicarbonate salt may be sodium bicarbonate. The bicarbonate may be present at from about 0.030 to about 0.045 parts (weight/volume). Preferably, the bicarbonate is present at about 0.035 parts (weight/volume).

The inventive composition comprises a further water-softening agent which may be a carbonate salt. Preferably, the carbonate salt may be sodium carbonate. The carbonate may be present at from about 0.055 to about 0.075 Preferably, the carbonate is present at about 0.065 parts (weight/volume).

The inventive composition comprises a natural soap. Preferably, the soap is a salt of a plant-derived fatty acid. Preferably, the soap is a salt of a $C_6$-$C_{20}$ fatty acid. The soap may be present at from about 0.050 to about 0.070 parts (weight/volume). Preferably, the soap is present at about 0.065 parts (weight/volume).

Aspects of the present invention provide methods of making a cleaning emulsion. An embodiment of the inventive method comprises forming a first aqueous co-solvent solution comprising a cocobetaine, a fatty glucoside, and a saponin, forming an aqueous solution of a terpene, forming an aqueous solution of a soap, forming an aqueous acid solution comprising a tetraborate, a bicarbonate, and a carbonate; mixing said first co-solvent solution and said terpene solution to form a co-solvent-terpene solution; and forming an emulsion by mixing said soap solution with said acid solution and said co-solvent-terpene solution.

EXAMPLE 1

In an exemplary non-limiting formulation of the invention, 0.75 ounces each of cocobetaine (coconut extract), decyl polyglucose (a fatty glucoside plant extract), and Mohave Yucca were blended with 16 ounces of distilled water for five minutes in a stainless steel mixer to form a first aqueous co-solvent solution.

Separately, 2.5 ounces of D-limonene was blended with 8 ounces of distilled water for two minutes in a stainless steel mixer to form a terpene solution. The terpene solution was mixed with the co-solvent solution for 15 minutes with gradual addition of a further 8 ounces of distilled water to form a terpene—co-solvent solution.

Separately, 32 ounces of distilled water were brought to about 160° F. and 8 ounces of soap flakes were added with mixing. The solution was brought to boil and maintained at the boiling point for one minute. The heat was reduced and held at about 90° F. for five minutes. The soap solution was removed from the heat and allowed to cool to between 70-75 degrees Fahrenheit.

The following dry compounds were added to a separate mixer containing 50 ounces of distilled water: 6.5 ounces sodium tetraborate (borax), 4 ounces sodium bicarbonate, and 8 ounces sodium carbonate. Mixing continued until for 0.5 hours or until all the dry materials were dissolved.

The cooled soap solution was mixed with the borax—carbonate solution for 15 minutes. Finally, the soap—borax—carbonate solution was mixed with the turpene—co-solvent solution and was brought to 128 ounces with the addition of water.

The emulsion was field-tested and was observed to disperse petroleum hydrocarbons.

The invention claimed is:

1. A cleaning emulsion comprising:
a betaine;
a fatty polyglycoside nonionic surfactant;
a saponin;
a terpene;
a tetraborate;
a bicarbonate;
a carbonate;
soap; and
water.

2. The cleaning emulsion of claim 1 wherein said betaine is derived from a plant source.

3. The cleaning emulsion of claim 2 wherein said betaine is a cocobetaine.

4. The cleaning emulsion of claim 1 wherein said polyglycoside is a polyglucose derived from a plant source.

5. The cleaning emulsion of claim 4 wherein said polyglucose is decylpolyglucose.

6. The cleaning emulsion of claim 1 wherein said saponin is derived from a plant source.

7. The cleaning emulsion of claim 6 wherein said saponin is derived from *Yucca Schidigera* or *Quillaia Saponara Molina*.

8. The cleaning emulsion of claim 1 wherein said terpene is a monoterpene.

9. The cleaning emulsion of claim 1 wherein said terpene is limonene.

10. A method of making a cleaning emulsion comprising:
forming a first aqueous co-solvent solution comprising a cocobetaine, a fatty glucoside, and a saponin;
forming an aqueous solution of a terpene;
forming an aqueous solution of a soap;
forming an aqueous acid solution comprising a tetraborate, a bicarbonate, and a carbonate;
mixing said first co-solvent solution and said terpene solution to form a co-solvent-terpene solution; and
forming an emulsion by mixing said soap solution with said acid solution and said co-solvent-terpene solution.

* * * * *